United States Patent [19]

Ogden

[11] Patent Number: 4,635,385

[45] Date of Patent: Jan. 13, 1987

[54] SHOE INSERT

[75] Inventor: John M. Ogden, Cincinnati, Ohio

[73] Assignee: Ogden Inc., Cincinnati, Ohio

[21] Appl. No.: 790,728

[22] Filed: Oct. 24, 1985

[51] Int. Cl.[4] ..... A43B 13/38

[52] U.S. Cl. ..... 36/43; 36/3 B

[58] Field of Search ..... 36/3 B, 3 R, 43, 44, 36/114; 128/588, 594

[56] References Cited

U.S. PATENT DOCUMENTS

| | | | |
|---|---|---|---|
| 354,693 | 12/1886 | Dick | 36/3 B |
| 1,106,986 | 8/1914 | Stucki . | |
| 1,994,681 | 3/1935 | Blumenfeld | 36/3 B |
| 2,300,681 | 11/1942 | Margolin . | |
| 2,432,533 | 11/1947 | Margolin | 36/3 R |
| 2,722,063 | 11/1955 | Drefvezin | 36/3 R |
| 3,383,782 | 5/1968 | McGinnity . | |
| 3,724,105 | 4/1973 | Weight | 36/44 |
| 4,179,826 | 12/1979 | Davidson . | |
| 4,237,626 | 12/1980 | Brown . | |
| 4,471,538 | 9/1984 | Pomeranz et al. . | |

FOREIGN PATENT DOCUMENTS

| | | | |
|---|---|---|---|
| Ad.69831 | 9/1958 | France | 36/3 B |
| 501878 | 3/1939 | United Kingdom | 36/44 |

*Primary Examiner*—James Kee Chi

*Attorney, Agent, or Firm*—Wood, Herron & Evans

[57] ABSTRACT

An insert, particularly for athletic shoes, is removably fitted over or affixed atop the top surface of the insole of the shoe and comprises a thin section of non-absorbant, thermally non-conductive thermoplastic material which is deformable to conform to the shape of the insole. The insert is formed with a plurality of spaced apertures to permit the passage of air and moisture between the sock and insole. The coefficient of friction of the uppermost surface of the insert is approximately equal to that of the skin of the foot so that movement of the foot and sock within the shoe is limited to reduce the incidence of turf toe, while permitting at least some motion of the foot and sock within the shoe especially during sudden stops or starts to avoid blistering of the foot.

12 Claims, 5 Drawing Figures

SHOE INSERT

BACKGROUND OF THE INVENTION

This invention relates generally to athletic shoes, and, more particularly, to a non-absorbant, thermally non-conductive insert overlying the insole of an athletic shoe.

New designs of athletic shoes in recent years have provided improvements in the support, cushioning and stability of the shoe in an effort to reduce injuries to the feet, ankles and knees. One aspect of athletic shoe design which has been overlooked, however, is the configuration and surface characteristics of the insole of the shoe.

Most insoles of athletic shoes are formed of a cushioning material such as rubber, foam or the like whose uppermost surface is covered by cloth or leather which contacts the sock of the wearer's foot. One problem with this type of insole is that the rubber or foam absorbs moisture from the sock like a sponge and does not allow the sock to dry. The cloth or leather top layer of some insoles are provided with tiny, spaced perforations to help channel away the moisture from the sock and provide ventilation, but the moisture is not prevented from being absorbed by the insole and simply flows back through the perforations to the sock. Additional ventilation openings are provided in the insole and/or fabric sides of the shoe in some shoe designs, but most of the moisture is nevertheless permitted to collect and pool in the insole which prevents the sock from drying.

Another problem with the insoles of currently available athletic shoes involves the frictional engagement between the cloth or leather top surface of the insole and the sock and foot of the wearer. In some prior designs, the top layer of the insole is formed of a relatively tacky or sticky material having a coefficient of friction which is higher than the frictional engagement between the sock and foot. Athletic shoes with this type of insole have been found to create blisters on the foot because during use the sock is held in a fixed position against the insole while the foot moves within the sock. The rubbing motion of the foot within the sock creates severe blistering and discomfort.

In an effort to solve the blistering problem described above, athletic shoes have been designed with insoles having a cloth or leather top surface which is relatively slippery or slick compared to the skin of the wearer's foot. These types of athletic shoes help avoid the blistering problem because the foot and sock move as a unit with respect to the slick upper surface of the insole instead of permitting the foot to move within the sock as in the other design described above.

The problem with insoles having a slick top surface is that a condition commonly referred to as "turf toe" often results, particularly on artificial playing surfaces. "Turf toe" refers to a condition involving the fracture of the metacarpalphalangeal joint of the big toe or second toe with attendant damage to the surrounding ligaments. A primary cause of this condition is the repeated, and often violent, contact of the big toe and second toe of the foot with the toe portion of an athletic shoe where the shoe permits the foot and sock to readily slide along the slick cloth or leather top layer of the insole of the shoe.

Accordingly, whereas an insole having an uppermost layer with a relatively high coefficient of friction often results in blistering of the wearer's foot, an insole having an upper surface with a low coefficient of friction permits too much sliding of the foot and sock often resulting in damage to the joints, bones and ligaments of particularly the big toe.

SUMMARY OF THE INVENTION

It is therefore among the objects of this invention to provide an insert which overlies the insole of an athletic shoe and closely conforms to its shape, which provides a moisture barrier between the wearer's sock and insole, which permits the circulation of air between the wearer's sock and insole and which has a coefficient of friction approximating that of skin so as to limit movement of the foot and sock with respect to the insole to reduce the incidence of turf toe while permitting at least some movement therebetween to avoid blistering of the foot.

These objectives are accomplished in an insert overlying the insole of an athletic shoe which comprises a thin section of non-moisture absorbant, thermally non-conductive material having sufficient flexibility to closely conform to the shape of the insole. In one embodiment the insert is removable from the shoe, or, alternatively, the insert is permanently affixed to the top surface of the insole. The thin section of material forming the insert includes a plurality of spaced apertures to permit the passage of air and moisture between the sock of the wearer's foot and the insole beneath. This moisture barrier helps keep the wearer's sock drier during any athletic activity. Because the sock remains drier, the wearer's foot is warmer during winter activities and cooler during summer activities.

In one presently preferred embodiment, the apertures are formed by a plurality of intersecting walls oriented in an array of spaced columns and spaced rows along the entire surface area of the insert. The columns and rows are substantially transverse to one another and regularly spaced so as to form square apertures therebetween. Preferably, the length of each wall of the square apertures is approximately 0.100 inches, and there are 36 apertures per square inch. In alternative embodiments, the walls forming the insert of this invention intersect one another to form apertures therebetween which are either triangular or hexagonal in shape.

The thin section forming the insert of this invention is a thermoplastic material, and preferably an ethylene-vinyl acetate copolymer sold commercially by U.S. Industrial Chemicals Company under the registered trademark ULTRATHENE UE 652-00. It has been found that a thin section of this material, formed in the apertured configurations described above, has a coefficient of friction when dry which approximates that of the skin of the foot. In other words, the frictional engagement between the sock of the wearer and the insert is approximately equal to the frictional engagement between the sock and the foot of the wearer.

The insert of this invention limits the sliding movement of the foot and sock within the shoe, but also permits at least some motion of the foot and sock particularly during violent movements such as sudden stops or starts, and sharp pivotal motions. This is because the frictional force between the sock and insert is approximately the same as the frictional force between the sock and skin of the foot so that during normal movement of the foot, e.g., running, walking or pivoting without abrupt motions, the foot and sock are held relatively stationary within the shoe atop the insole. At the same time, the coefficient of friction of the insert herein is low enough to permit movement of the foot and sock as a unit therealong, particularly during abrupt motion of the foot. The frictional characteristics of the insert herein thus greatly reduce blistering of the foot, and the incidence of turf toe, which have been problems in other athletic shoe designs.

DETAILED DESCRIPTION OF THE DRAWINGS

The structure, operation and advantages of a presently preferred embodiment of this invention will become further apparent upon consideration of the following description, taken in conjunction with the accompanying drawings, wherein.

DETAILED DESCRIPTION OF THE INVENTION

Figure 1:
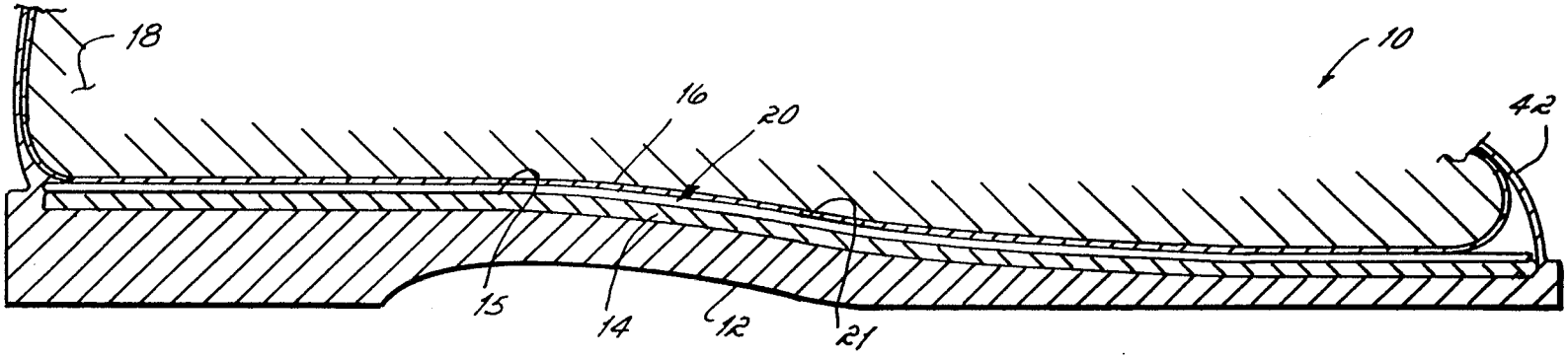
FIG. 1 is a partial cross sectional view of an athletic shoe incorporating one embodiment of the insert of this invention.

Referring now to the drawings, a schematic view of an athletic shoe 10 is illustrated having a sole 12 and an insole 14 secured atop the sole 12 which support the sock 16 and foot 18 of the wearer. The insert 20 of this invention overlies the top surface 15 of the insole 14 and is shaped like a footprint to conform to the shape of the insole 14. It is contemplated that the insert 20 may be a separate section of material which is removably inserted into the shoe 10 over the insole 14, or, alternatively, the insert 20 can be permanently affixed atop the insole 14.

Figure 2:
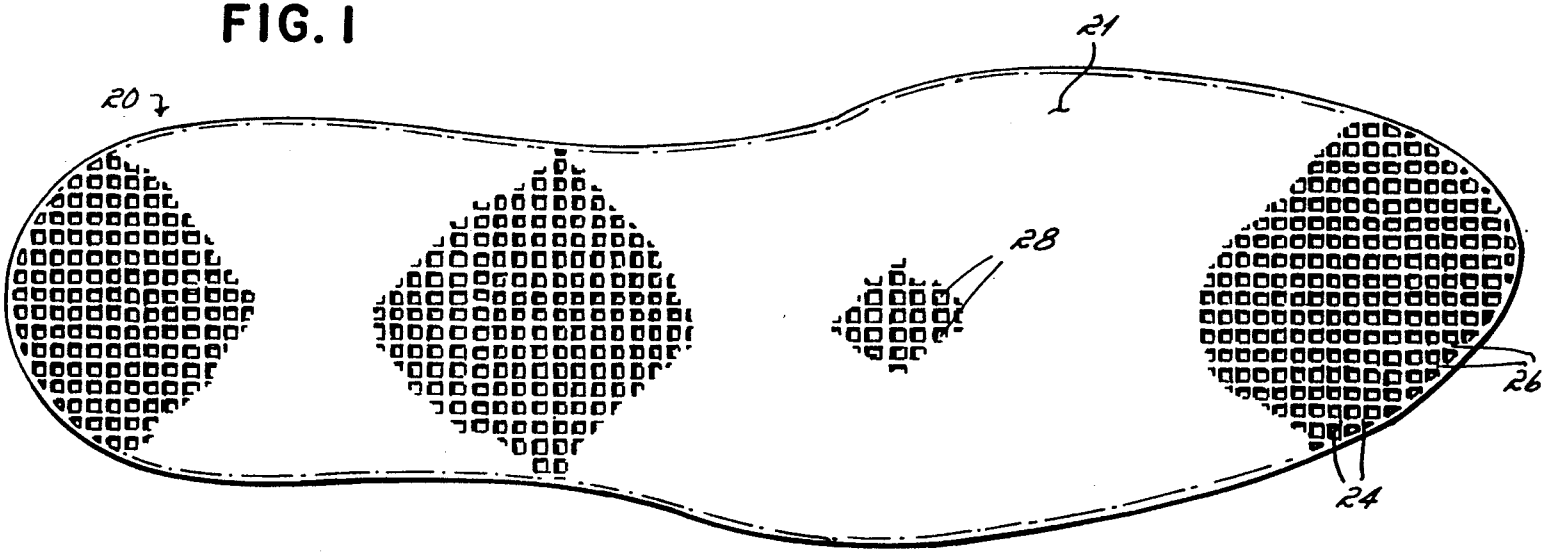
FIG. 2 is a plan view of the insert shown in FIG. 1.
Figure 3:
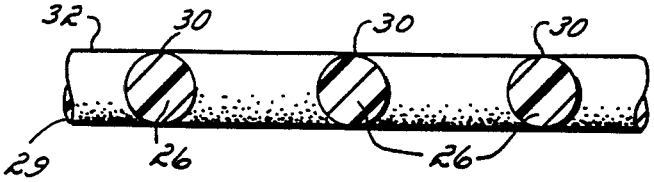
FIG. 3 is a partial cross sectional view of the wall configuration of the insert shown in FIGS. 1 and 2.

As shown in FIGS. 2 and 3, in one presently preferred embodiment the insert 20 comprises an outer perimeter wall 22 in the shape of a footprint and a plurality of spaced vertical walls 24 and spaced horizontal walls 26 connected interiorly of the perimeter wall 22. The vertical and horizontal walls 24, 26 intersect one another at regular intervals forming a plurality of apertures 28, each in the shape of a square. As shown in FIG. 3, the vertical and horizontal walls 24, 26 are generally circular in cross section forming arcuate uppermost surfaces 30, 32, respectively.

In one presently preferred embodiment of this invention, the walls of each square aperture 28 are approximately 0.100 inches in length, and there are preferably thirty-six apertures 28 in each square inch of surface area of the insert 20. In addition, the thickness or diameter of the walls 24, 26, and the outer perimeter wall 22, is approximately 0.056 inch.

Figure 4:
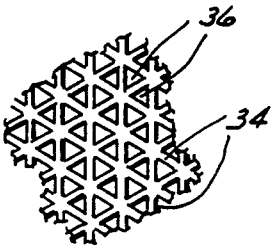
FIG. 4 is a partial view of the insert according to this invention showing an alternative embodiment of the aperture configuration.
Figure 5:
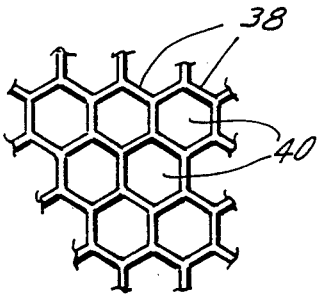
FIG. 5 is a partial view of the insert herein showing a still further embodiment of the aperture configuration of this invention.

Referring to FIGS. 4 and 5, alternative embodiments of the aperture configuration of insert 20 are shown. In FIG. 4, a portion of an alternative embodiment of the insert 20 is illustrated having a plurality of intersecting walls 34 forming triangular shaped apertures 36 therebetween of substantially equal size. In FIG. 5, the walls 38 are arranged to form hexagon shaped apertures 40 each having about the same area. In addition, the walls 34, 38 of the embodiments shown in FIGS. 4 and 5, respectively, are formed with substantially the same circular cross section as the walls 24, 26 shown in FIG. 3.

In a presently preferred embodiment of this invention, the insert 20 is formed by injection molding an ethylene vinyl acetate copolymer, commercially available from U.S. Industrial Chemicals Company of Tuscola, Ill. under the registered trademark "Ultrathene" UE 652-00. Ultrathene thermoplastic material does not absorb moisture and is thermally non-conductive. In addition, the material is deformable so that the insert 20 conforms precisely to the shape of the insole 14 after a short period of use of the shoe 10.

The coefficient of friction of the uppermost surface 21 of insert 20 which contacts the sock 16 is a critical aspect of this invention. It has been experimentally determined that the insert 20 of this invention having any ,of the aperture configurations illustrated in FIGS. 2, 4 and 5, and being formed of Ultrathene copolymer, has a coefficient of friction approximating that of the skin of the foot. In other words, the frictional force between the foot 18 and sock 16 of the wearer is approximately the same as the frictional force between the sock 16 and uppermost surface 21 of the insert 20.

If the coefficient of friction of the uppermost surface 21 of insert 20 were too high, that is, greater than that of the skin of the foot 18, the sock 16 would adhere to the insert 20 allowing the foot 18 to slide within the sock 16. This sliding motion of the foot 18 with respect to the sock 16 would cause severe blisters and discomfort. On the other hand, if the coefficient of friction of the uppermost surface 21 of the insert 20 were too low, that is, less than that of the skin of the foot 18, the foot 18 and sock 16 would move as a unit atop the insert 20. Constant motion of the foot 18 and sock 16 within the shoe 10 has been found to injure the toes as they ram against the toe portion 42 of the shoe 10.

By providing the uppermost surface 21 of insert 20 with a coefficient of friction which approximates that of skin, movement of the foot 18 within the shoe 10 is limited in two respects. First, the foot 18 is prevented from freely moving with respect to the sock 16 because as the foot 18 begins to move within sock 16 the sock 16 itself begins to move along the uppermost surface 21 of insert 20. This prevents rubbing motion between the foot 18 and sock 16. The coefficient of friction of the uppermost surface 21 of insert 20 is high enough, however, to prevent movement of the foot 18 and sock 16 as a unit against the toe portion 42 of the shoe 10, except during violent motion such as sudden stops and accelerated starts, or sharp pivotal movements. Constant impact of the foot 18 against the toe portion 42 of the shoe 10 is thus eliminated by the insert 20 of this invention.

The apertured configuration of insert 20 also provides a moisture barrier between the sock 16 and insole 14. Moisture from the sock 16 is allowed to seep through the apertures 28 in insert 20, without being absorbed by the walls 24, 26, to aid in keeping the sock 16 dry. In addition, such apertures 28 allow for the passage of air between the insole 14 and sock 16 to further aid in drying thereof. Since the thermoplastic material forming insert 20 is thermally non-conductive and provides a moisture barrier to reduce the moisture content of the sock 16, the sock 16 is maintained cooler during summer activities and warmer during winter activities.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

Wherefore I claim:

1. An insert for a shoe having an insole comprising:

a thin section of non-absorbent, thermally non-conductive material adapted to overlie at least a portion of the insole of the shoe, said section being deformable to conform to the shape of the insole;

said section being formed with a plurality of apertures to permit the passage of air and moisture from a foot and sock resting atop said section to the insole beneath said section;

said section having an uppermost surface with a coefficient of friction approximately equal to the coefficient of friction of the skin of the foot so as to limit movement of the foot and sock with respect to the insole to reduce the incidence of turf toe while permitting at least some movement of the foot and sock relative to the insole to reduce blistering of the foot.

2. The insert of claim 1 in which said section is formed of an ethylene-vinyl acetate copolymer.

3. The insert of claim 1 in which said apertures are square in shape, each side of said square aperture being about 0.100 inch in length.

4. The insert of claim 3 in which said section is formed with about 36 of said square apertures in each square inch of area thereof.

5. The insert of claim 1 in which said apertures are triangular in shape.

6. The insert of claim 1 in which said apertures are hexagonal in shape.

7. The insert of claim 1 in which said thin section further includes an outer, perimeter wall and a plurality of intersecting walls extending interiorly of and being connected to said perimeter wall.

8. The insert of claim 7 in which said intersecting walls are oriented in an array of spaced columns and spaced rows, said columns intersecting said rows at regular intervals to form square apertures therebetween.

9. The insert of claim 7 in which said outer perimeter wall and said intersecting walls are each formed with a uppermost, arcuate surface for engagement with the sock or foot of the wearer of the shoe.

10. An insert for a shoe having an insole comprising:

a thin section of non-absorbent, thermally non-conductive material adapted to overlie at least a portion of the insole of the shoe, said section being deformable to conform to the shape of the insole;

said section being formed with a plurality of apertures to permit the passage of air and moisture from a foot and sock resting atop said section to the insole beneath said section;

said section having an uppermost surface contacting the sock with the frictional force therebetween being approximately equal to the frictional force between the sock and the foot of the wearer so as to limit movement of the foot and sock with respect to the insole to reduce the incidence of turf toe while permitting at least some movement of the foot and sock relative to the insole to reduce blistering of the foot.

11. A shoe comprising;

a bottom sole;

an insole mounted atop said bottom sole, said insole having a top surface;

an isert overlying at least a portion of said top surface of said insole, said insert being formed of a non-absorbant, thermally non-conductive deformable material;

said insert being formed with a plurality of apertures to permit the passage of air and moisture from a foot and sock resting atop said insert to said insole beneath said insert;

said insert having an uppermost surface with a coefficient of friction approximately equal to the coefficient of friction of the skin of the foot so as to limit movement of the foot and sock with respect to the insole to reduce the incidence of turf toe while permitting at least some movement of the foot and sock relative to the insole to reduce blistering of the foot.

12. A shoe comprising:

a bottom sole;

an insole mounted atop said bottom sole, said insole having a top surface;

an insert overlying at least a portion of said top surface of said insole, said insert being formed of a non-absorbant, thermally non-conductive deformable material;

said insert being formed with a pluality of apertures to permit the passage of air and moisture from a foot and sock resting atop said insert to said insole beneath said insert;

said insert having an uppermost surface contacting the sock with the frictional force therebetween being approximately equal to the frictional force between the sock and the foot of the wearer so as to limit movement of the foot and sock with respect to the insole to reduce the incidence to turf toe while permitting at least some movement of the foot and sock relative to the insole to reduce blistering of the foot.

* * * * *